US006779331B1

(12) United States Patent
Weinberg

(10) Patent No.: US 6,779,331 B1
(45) Date of Patent: Aug. 24, 2004

(54) JEWELRY CHAIN LINK WITH FACETED SIDES

(76) Inventor: Eitan Weinberg, 18 Regent Dr., Hopewell Junction, NY (US) 12533

( * ) Notice: Subject to any disclaimer, the term of this patent is extended or adjusted under 35 U.S.C. 154(b) by 0 days.

(21) Appl. No.: 10/291,285

(22) Filed: Nov. 8, 2002

(51) Int. Cl.[7] ..... B21L 5/02
(52) U.S. Cl. ..... 59/80; 59/35.1; D11/13
(58) Field of Search ..... 59/78, 80, 35.1; D11/13

(56) References Cited

U.S. PATENT DOCUMENTS 5,185,995 A * 2/1993 Dal Monte ..... 59/80
5,361,575 A * 11/1994 Rozenwasser ..... 59/80
5,537,812 A * 7/1996 Rozenwasser ..... 59/80
D449,790 S * 10/2001 Scortecci ..... D11/13
6,460,323 B1 * 10/2002 Rosenwasser et al. ..... 59/80
6,532,725 B1 * 3/2003 Chia et al. ..... 59/35.1
6,560,955 B1 * 5/2003 Chia et al. ..... 59/80
D476,591 S * 7/2003 Klein et al. ..... D11/13

* cited by examiner

*Primary Examiner*—David Jones
(74) *Attorney, Agent, or Firm*—Levisohn, Berger & Langsam, LLP

(57) ABSTRACT

A jewelry link is formed of a general planar configuration in which the outer sides of the link are formed of sculpted or faceted surfaces to enhance the reflectivity of the link and a jewelry chain formed of a plurality of the links.

18 Claims, 2 Drawing Sheets

JEWELRY CHAIN LINK WITH FACETED SIDES

BACKGROUND OF THE INVENTION

This invention relates to the formation of decorative links used to form jewelry chains.

One of the objectives of jewelry chain manufacturers is to make chains which are light yet highly reflective of ambient light to make the chains more attractive. Making jewelry lighter reduces the cost yet providing enhanced visual reflective effects enhances the value. An object of this invention is to provide enhanced value for less cost.

The formation of links used in jewelry chains is an art that has existed for many, many years. Generally, links for chains are formed of regular polygonal or round structures, and such links when individually formed, usually are formed with gaps to permit intertwining of the links to form the jewelry chain.

Additionally, the manufacturing process for individual links is an important aspect of the jewelry chain process. It is preferable to provide manufacturing techniques which are simple to execute, inexpensive to perform and which provide highly desirable accurate and repetitive jewelry chain links with minimal scrap and waste.

An object of this invention is to provide an improved link for chain jewelry.

Another object is to provide such a link which when utilized to form a chain provides highly enhanced reflective qualities.

Still another object of this invention is to provide such links which are hollow, lightweight and generally inexpensive.

Another object of this invention is to provide a technique for manufacturing such links which is easily able to be modified to adjust the formation of said links to various desired aesthetic looks.

Another object of this invention is to provide such a manufacturing technique which will be reliable, efficient and able to be performed by low skilled employees.

Still another object of this invention is to provide such a manufacturing technique which is readily adaptable to meet a variety of manufacturing needs.

Other objects, advantages and features of this invention will become more apparent from the following description.

SUMMARY OF THE INVENTION

In accordance with the above objects, a link formed in accordance with the teachings of this invention has an outer peripheral edge, an inner peripheral edge, and sides between the peripheral edges. In accordance with the principles of this invention, the sides of the links are faceted to provide at least two faceted surfaces on a side. By faceting the surfaces on the sides of the links, the reflective qualities of the ultimate chain assembled using such links will be enhanced.

Additionally, each link, preferably, may be formed with the sides tapered inwardly from the outer peripheral edge to the inner peripheral edge so as to further enhance the reflective quality by providing slanted side edges. Single or double slanted side edges may be provided with the slant of each towards each other being equal, different or any desired variation. The sides could also be slanted outwardly rounded to take on any other configuration achievable with sculpting the side surfaces. Additionally, the link can be formed as a regular polygon, with a faceted surface for each segment of the polygon. For instance, if the link is eight sided, in accordance with this invention, eight facets may be provided on each side corresponding to the eight segments of the octagon shaped link. Additionally, the faceting along the sides can be co-extensive with the segments, overlap the segments, or be any variation thereof.

In accordance with a feature of this invention, forming the faceted surface on the sides may be accomplished by utilizing apparatus described in a prior patent application of the same inventor, Ser. No. 09/779,774, filed Mar. 8, 2001, which is incorporated herein by reference.

DETAILED DESCRIPTION

Figure 1:
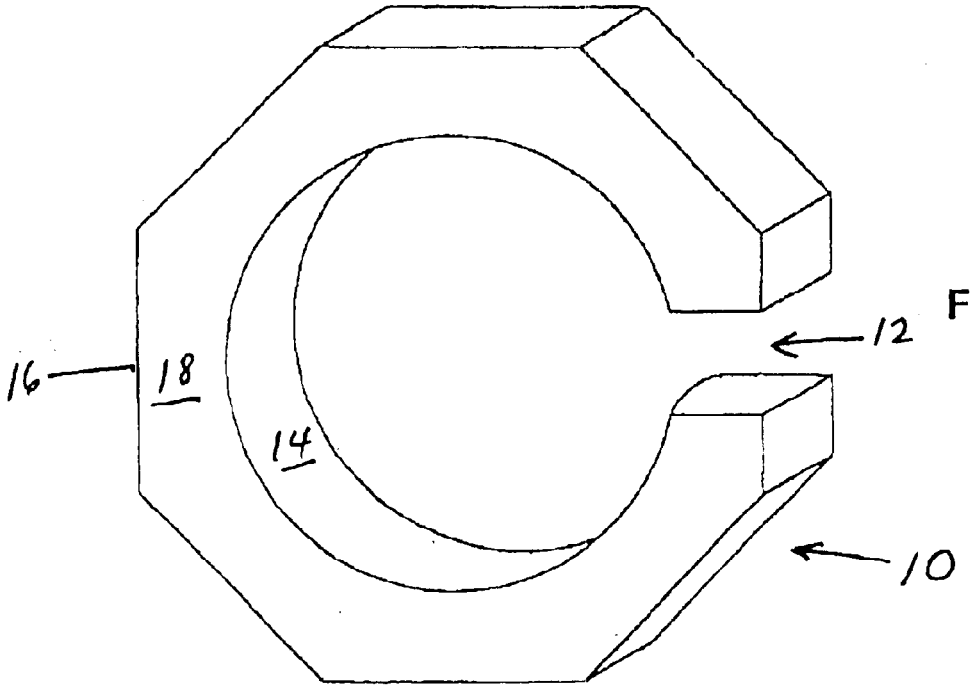
FIG. 1 is a perspective view of a prior art link used for jewelry rope chains.

FIG. 1 is a perspective view of an eight sided prior art jewelry chain link 10 having a gap 12 allowing the links to be intertwined. A regular octagonal shape is shown, and this is one of many shapes which is generally used for such jewelry links. The link has an inner peripheral edge 14, an outer peripheral edge 16 and sides 18 therebetween. In a conventional jewelry rope chain link, sides 18 are flat, parallel to each other and connect the outer and inner peripheral edges. In such jewelry links, the outer peripheral edge 16 primarily is relied upon for providing the reflective qualities for assembled rope chain, for example. For other type jewelry chains, the reflective qualities also primarily rely on the outer peripheral edges.

Figure 2:
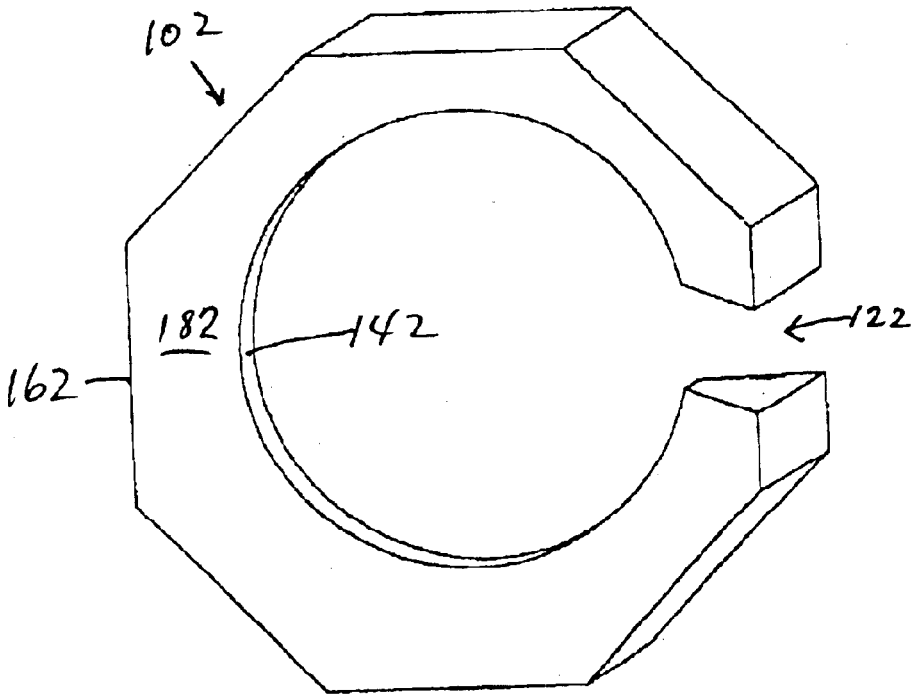
FIG. 2 is a perspective view of a first embodiment of this invention.

FIG. 2 is a perspective view of a first embodiment of this link invention 102 in which sides 182 are slanted inwardly as shown in cross-section. The sides are slanted inwardly from the outer peripheral edge 162 to the inner peripheral edge 142 so as to enhance the reflective qualities and brilliance of the link and assembled jewelry chain including the rope chain assembled in accordance with this invention. Each link can be formed hollow or solid as desired, although when formed as a hollow link, the cost of each link is materially reduced. Gap 122 is also provided in the link of FIG. 2.

Figure 3:
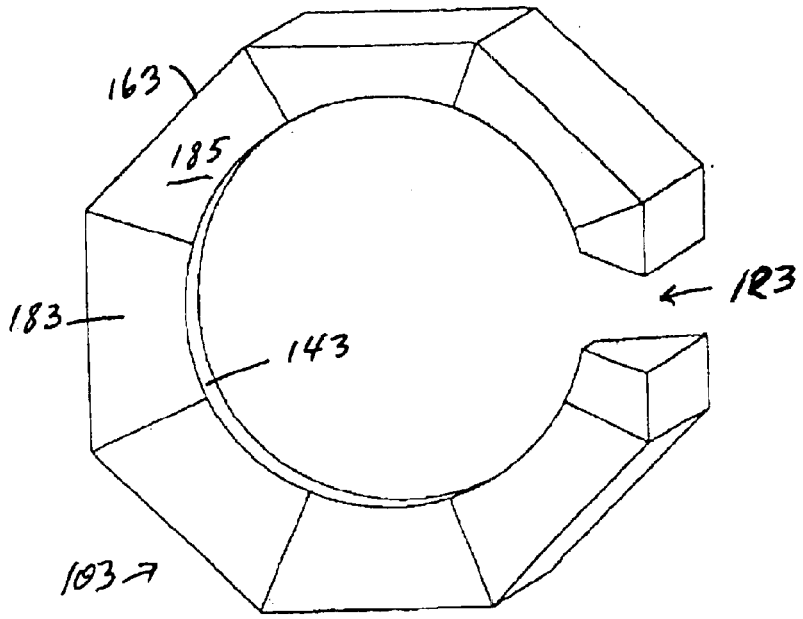
FIG. 3 is a perspective view of a second embodiment of this invention.

FIG. 3 is a perspective view of yet another embodiment of this invention in which sides 183 are slanted as in FIG. 2, but each side 183 is also faceted as shown by segments 185. As illustrated in FIG. 3, an eight-sided polygonal shape is provided for link 103, and the polygonal shape has eight segments 185. A faceted surface forms each segment 185 corresponding to the eight-sided shape of the link 103. The faceted surface on each segment 185 may comprise the same slant or slope or may be different as desired. Further, sides 183 may be equally slanted as in FIG. 2 or only one side 183 may be slanted while the other side could be straight, as shown in FIG. 1. The number of segments is equal to the number of sides of the regular polygon of FIG. 3, and the faceting is also equal to such number of segments. Adjacent segments 185 can be formed with different slants to further enhance the effect of the faceted surfaces.

Additionally, the number or extent of the slanted segments need not be equal to the number of or be coextensive with each segment of the link, so that there could be five, ten or twenty faceted surfaces formed in the sides 183, which may or may not correspond to the extent of each segment. Ultimately, the number of facets formed in the sides is a matter of choice of the designer.

Figure 4:
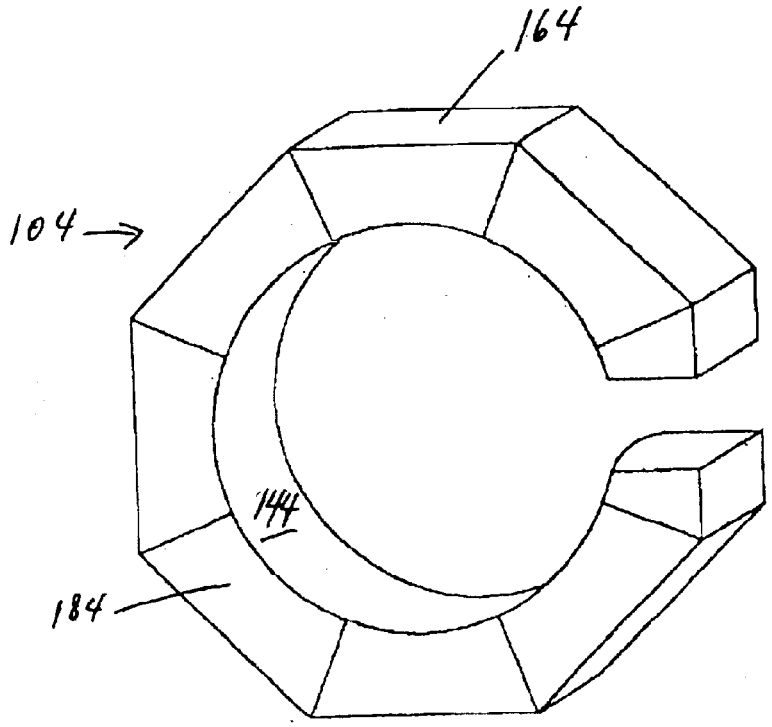
FIG. 4 is a perspective view of a third embodiment of this invention.

FIG. 4 is yet another embodiment of this invention in which the overall silhouette of the sides 184 are parallel and not slanted towards each other, but the sides do comprise a plurality of individual segments which may include faceted surfaces as illustrated in FIG. 4. The faceting can take the form of individual slants for each segment or parts thereof or any other combination. Additionally, as described with respect to FIG. 3, the number of facets may be different from the number of segments.

In accordance with the principles of this invention, the surfaces of the sides of the links may be faceted by placing each link between opposed surfaces configured to impart appropriate faceting. FIGS. 3 and 4 of my prior patent application 09/779,774 illustrate that opposed wall surfaces 30 and 40 compress against opposite sides of a link to compress it. In accordance with this invention, a tool comprising the desired faceting is mounted between the respective side wall surfaces and sides of the link to impart the desired slanting and/or faceting to the sides. To form hollow links, outside precious metal surrounds an inner metal such as steel or copper which is chemically dissolved to form a hollow link for which the sides have been faceted as described above.

The tool used with opposed wall surfaces 30 and 40 may enable other sculpting for the faceted side surfaces, such as outwardly slanted, rounded, etc., so as to provide a wide variety of side sculpted or faceted surfaces.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

What is claimed is:

1. A link for a jewelry chain, said link comprising a polygon shape and having an outer peripheral circumferential edge and an inner circumferential peripheral edge, and a pair of opposite sides located between said inner and outer peripheral edges, the distance between said sides defining the thickness of said link, at least one of said opposite sides comprising at least two faceted surfaces, said at least two faceted surfaces extending in a side circumferential direction and forming said at least one side, said at least two faceted surfaces comprising borderlines therebetween extending from the center to the inner circumferential edges defining said faceted surfaces.

2. A link for a jewelry chain as defined in claim 1, wherein each of said sides comprises said at least two faceted surfaces.

3. A link for a jewelry chain as defined in claim 2, wherein the appearances of the faceted surfaces on the sides are different one from the other.

4. A link for a jewelry chain as defined in claim 2, wherein the opposite sides are straight.

5. A link for a jewelry chain as defined in claim 4, wherein the opposite sides are parallel to each other.

6. A link for a jewelry chain as defined in claim 2, wherein said opposite sides are tapered inwardly from the outer circumferential peripheral edge to the inner circumferential peripheral edge.

7. A link for a jewelry chain as defined in claim 2, wherein at least one of said opposite sides is tapered inwardly from the outer peripheral edge to the inner peripheral edge.

8. A link for a jewelry chain as defined in claim 1, wherein the link comprises a regular polygon formed of a plurality of outer straight edges, with the number of faceted surfaces being equal to the number of the plurality of outer straight edges with each faceted surface being coextensive with a respective outer straight edge.

9. A link for a jewelry chain as defined in claim 1, wherein each of said opposite sides comprise the same number of faceted surfaces.

10. A link for a jewelry chain as defined in claim 1, wherein each of said opposite sides comprise a different number of faceted surfaces.

11. A link for a jewelry chain as defined in claim 1, wherein said link comprises a regular polygonal shape comprising a plurality of segments, with each of said segments having straight outer edges.

12. A link for a jewelry chain as defined in claim 11, said plurality of segments equal to the number of sides forming said polygon shape, wherein each segment of said polygonal shape comprises a faceted surface on both sides thereof.

13. A link for a jewelry chain as defined in claim 12, wherein the appearance of at least one of said faceted surfaces is different from the other faceted surfaces.

14. A link for a jewelry chain as defined in claim 11, wherein the number of faceted surfaces is different from the number of outer edges.

15. A link for a jewelry chain as defined in claim 1, wherein the link is formed of solid precious metal.

16. A link for a jewelry chain as defined in claim 1, wherein said link comprises a hollow structure made of precious metal.

17. A link for a jewelry chain as defined in claim 1, wherein the links is formed of a thin wall structure.

18. A link for a jewelry chain as defined in claim 1, wherein the link comprises a gap used to interconnect a plurality of said links to form said chain.

* * * * *